US007066102B1

(12) United States Patent
Tossavainen

(10) Patent No.: US 7,066,102 B1
(45) Date of Patent: Jun. 27, 2006

(54) MOORAGE FOR AFFIXING TO A FLOATING DOCK AND ALLOWING A USER TO SINGLE HANDEDLY SOFT LAND, DOCK AND MOOR A BOAT THERETO

(76) Inventor: Raimer E. Tossavainen, P.O. Box 188, Lakebay, WA (US) 98349

( * ) Notice: Subject to any disclaimer, the term of this patent is extended or adjusted under 35 U.S.C. 154(b) by 0 days.

(21) Appl. No.: 11/105,337

(22) Filed: Apr. 13, 2005

(51) Int. Cl.
*B63B 21/00* (2006.01)

(52) U.S. Cl. ..... 114/230.1

(58) Field of Classification Search ..... 114/230.1, 114/230.15, 230.18, 230.19, 44; 280/414.1, 280/414.2

See application file for complete search history.

(56) References Cited

U.S. PATENT DOCUMENTS

| | | | | |
|---|---|---|---|---|
| 2,187,706 | A | 1/1940 | Julien | |
| 2,389,535 | A | 11/1945 | Foss | |
| 2,577,790 | A | 12/1951 | Mccormick | |
| 2,662,501 | A | 12/1953 | Bascome, Jr. | |
| 3,060,885 | A | 10/1962 | Nolf | |
| 3,177,839 | A * | 4/1965 | Nolf | 114/230.18 |
| 3,237,587 | A | 3/1966 | Ross | |
| 4,351,259 | A | 9/1982 | Loire | |
| 5,113,702 | A | 5/1992 | Capps | |
| 5,172,928 | A * | 12/1992 | Capps | 280/414.1 |
| 5,174,234 | A | 12/1992 | Ryan | |
| 5,441,007 | A | 8/1995 | Hunt | |
| 5,762,016 | A | 6/1998 | Parsons | |
| 6,000,356 | A * | 12/1999 | VanAssche et al. | 114/230.1 |
| 6,119,616 | A * | 9/2000 | Hannasch | 114/230.1 |
| 6,422,169 | B1 | 7/2002 | Schwantes | |
| 6,575,110 | B1 | 6/2003 | Nelson | |

* cited by examiner

*Primary Examiner*—Lars A. Olson
(74) *Attorney, Agent, or Firm*—Richard L. Miller

(57) ABSTRACT

A moorage for affixing to a floating dock and allowing a user to single handedly soft land, dock, and moor a boat thereto. Attaching apparatus attaches to the floating dock. Bow stop apparatus is connected to the attaching apparatus by connecting apparatus and is engaged by a bow of the boat during mooring. The connecting apparatus is generally vertically-oriented, straight, slender, and elongated. The attaching apparatus includes a lower portion and an upper portion which both receive a lower end of the connecting member. The bow stop apparatus includes a pair of plates that diverge away from the connecting member. In an alternate embodiment, the pair of plates are resiliently attached to the connecting apparatus by coil springs that act as shock absorbers when the pair of plates are impacted upon by the bow of the boat during mooring.

99 Claims, 3 Drawing Sheets

FIG. 1
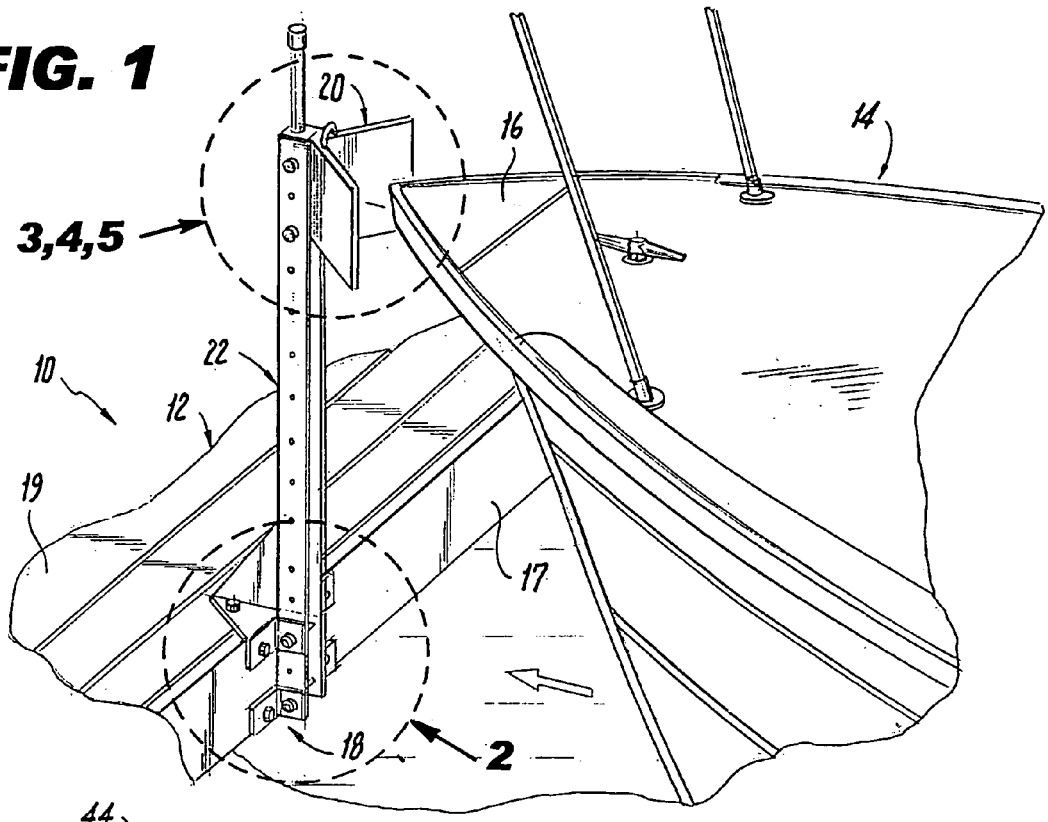
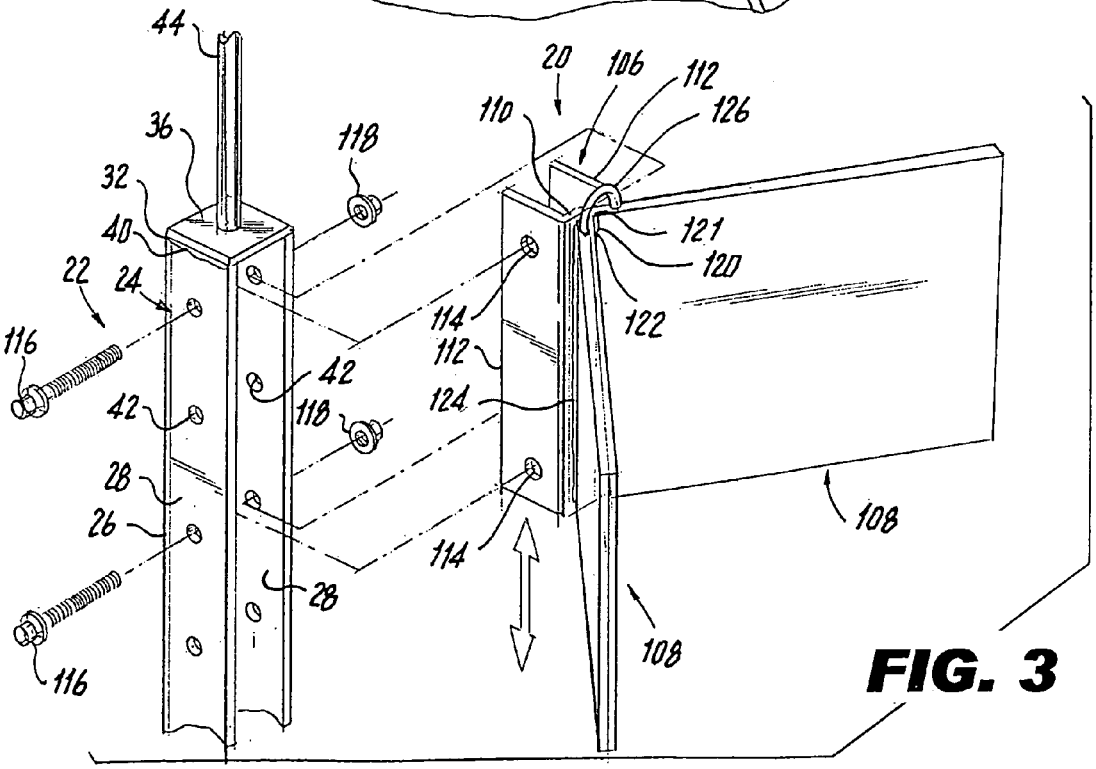
FIG. 3

MOORAGE FOR AFFIXING TO A FLOATING DOCK AND ALLOWING A USER TO SINGLE HANDEDLY SOFT LAND, DOCK AND MOOR A BOAT THERETO

BACKGROUND OF THE INVENTION

1. Field of the Invention

The present invention relates to a boat docking apparatus, and more particularly, the present invention relates to a moorage for affixing to a floating dock and allowing a user to single handedly soft land, dock, and moor a boat thereto.

2. Description of the Prior Art

Numerous innovations for boat docking apparatuses have been provided in the prior art that will be described. Even though these innovations may be suitable for the specific individual purposes to which they address, however, they differ from the present invention.

A FIRST EXAMPLE, U.S. Pat. No. 2,187,706 to Julien teaches a universal joint for transmitting power with a considerable torsional conical and axial elasticity from a driving shaft to a driven shaft in substantial alignment therewith and comprising in concentric relation an outer drum connected to one shaft, an inner hub connected to the other shaft, the inner hub having a diameter smaller than ⅔ the diameter of the the drum, and an elastic coupling member extending between and connecting the drum and the hub, the elastic coupling member having an annular shape with a minimum thickness in axial direction, the minimum thickness being smaller than the radial width of the the member between the hub and the drum, the elastic coupling member comprising a plurality of concentrically arranged annular bodies of an elastic material, closed metal rings being inserted between the annular bodies.

A SECOND EXAMPLE, U.S. Pat. No. 2,389,353 to Foss teaches a dock construction comprising a floating dock unit, a plurality of anchoring elements completely embedded in the ground beneath the water, and normally slack flexible elements connecting the dock unit to the anchoring elements at points spaced from the top surface of such ground, the flexible elements being connected to the dock unit at oppositely facing points and diverging downwardly at substantially uniform angles to the vertical.

A THIRD EXAMPLE, U.S. Pat. No. 2,577,790 to McCormick teaches a hook having a concave surface forming a bay and extensions curving oppositely away to comprise ends opposite each other with a gap between them, a detent housed in the structure at one of the ends of the hook and being directed towards the oppositely disposed end, a spring for the detent housed therewith and tensioned to actuate the detent towards and into engagement with the oppositely disposed hook end, detent control mechanism housed in the structure and comprising a gripper for the detent, a spring for the gripper and an actuating finger extending from the gripper and projecting out of the structure into the bay to a position away from the concave surface of the bay, the gripper being movable alternatively out of engagement with the detent and into engagement therewith to hold the detent against actuation by the detent spring, the gripper spring being tensioned to actuate the gripper into holding engagement with the detent and simultaneously move the abutment finger away from the concave surface of the bay, actuation of the abutment finger towards the concave surface by an object in the bay of the hook being opposed to the gripper spring and operating to move the gripper out of engagement with the detent to release the detent for its actuation by its spring.

A FOURTH EXAMPLE, U.S. Pat. No. 2,662,501 to Bascome Jr. teaches a restraining device to prevent the lateral deflection of a floating small boat moored bow end to a boat landing structure connected to a shore, comprising a support adapted to be mounted on the structure, a pair of opposed arms removably and pivotally mounted on the support for vertical angular motion, the arms being diverged so as to enable the arms to be adapted to straddle the bow and engage the forward opposite sides of the boat to be restrained, and spring means associated with each the arm tending to resist its lateral deflection.

A FIFTH EXAMPLE, U.S. Pat. No. 3,060,885 to Nolf teaches a docking mechanism for boats, the combination of: a docking bar having mounting means thereupon for securing the bar to a boat; automatic grasping and holding means for the bar securable to a wharf the automatic grasping and holding means including an elongated tube on the wharf, a rod slidable in the tube and a cushioning element on the rod, the grasping and holding means including a semi-circular spring element having inwardly and angularly directed spring arms movable away from each other to allow passage of the bar therebetween, the arms having locking means thereupon to prevent accidental release of the bar; and a float connected to the rod adapted to maintain the spring element at a desired height above the water level.

A SIXTH EXAMPLE, U.S. Pat. No. 3,177,839 to Nolf teaches boat docking apparatus comprising: a docking rail attachable to the bow of a boat in a substantially vertical plane; a mount attachable to a dock and including a cylinder projecting horizontally forwardly when thus attached; a plunger slidable in the cylinder and including a shank projecting from the forward end of the cylinder; resilient shock-cushioning means interposed between the rear end of the plunger and the rear end of the cylinder; a yoke secured to the forward end of the plunger, the yoke comprising laterally spaced parallel ways; guide arms secured to the ways and projecting therefrom in forwardly diverging relation in a horizontal plane; a trigger having in its forward end a notch to receive the docking bar, the trigger bridging between and having parallel side marginal portions slidable mounted in the ways, the guide arms being arranged to guide the docking bar against the forward end of the trigger and into the notch so as to automatically effect rearward retraction of the trigger in response to boat-docking movement; a cocking spring engaging the rear end of the trigger and loading it for forward projection to a cocked position for engagement by the docking rail; and a latch comprising a guide barrel attached to a the of the yoke and projecting transversely to the axis of the cylinder, a latch bolt slidable in the barrel, the bolt having a forward end abutting a side of the trigger when the latter is in the cocked position whereby the bolt is held in a retracted position, a latch spring engaged under compression between the rear end of the bolt and the end of the barrel and loading the bolt for projection from the retracted position past the forward end of the trigger and across the docking bar so as to latch the same to the yoke when the trigger is retracted by the docking bar.

A SEVENTH EXAMPLE, U.S. Pat. No. 3,237,587 to Ross teaches a system of docking and mooring boats relative to a boat well having a well base dock structure, and two outwardly extending well side dock structures defining therebetween the boat well, the improvement which comprises first cable means connected at one end to the base dock structure at a point spaced from a first of the side dock structures and passing over the boat well to a connection at its other end on the the first side dock structure adjacent the free end of the latter; resilient means in the cable between the end connections thereof, second cable means connected at one end to the base dock structure at a point spaced from a second of the side dock structures and passing over the boat well to a connection at its other end on the the second side dock structure adjacent the free end of the latter; resilient means in the second cable intermediate the end connections thereof, the first and second cables crossing one another in the boat well.

AN EIGHTH EXAMPLE, U.S. Pat. No. 4,351,259 to Loire teaches a single point mooring and fender suitable for large ocean going vessels. A dolphin is embraced by two fender bars in crossing relationship and having at least one resilient yielding member to resist spreading.

A NINTH EXAMPLE, U.S. Pat. No. 5,113,702 to Capps teaches a boat dock for use to store boat therein, the boat dock including a boat slip having an open entry, opposed sidewalls and a front, a dock guard secured to each dock sidewall at the entry and extending laterally from the sidewall to which it is attached and forwardly of the entry. A first intermediate guard affixed to one of the dock sidewalls and extending a short distance from the sidewall, a second intermediate guard affixed to the other sidewall opposite to the first intermediate guard, the second intermediate guard extending a short distance from the sidewall, the first intermediate guard being adjustable so that the spacing between the first and second intermediate guards is that which is slightly greater than the width of the boat to which the dock is adapted and a pair of padded stop members secured to the dock front and spaced apart and positioned to receive the forward position of the boat bow therebetween and a winch secured to the dock front between the pair of padded stop members, the winch having a retractable flexible member, the outer end of which is attached to the bow of the boat.

A TENTH EXAMPLE, U.S. Pat. No. 5,174,234 to Ryan teaches a boat docking system having a V-shaped horizontal floating structure held together by two underwater bents. The structure is constructed of two flexible fiberglass rods which allows the structure to open up and conform to a shape of a boat inserted into the V-shape. The two bents acts as spring clips to open up the V-shape against resilient force, and to thereafter close around the contour of the boat. The V-shape structure is floated intermittently by tubular foam buoys fixed along lengths of the V-shape structure. A strut anchored to the dock at one end and attached to the V-shape structure at another end with a sliding joint gives stability to the floating structure as well as provides the proper distance during docking of the boat to the walkway.

AN ELEVENTH EXAMPLE, U.S. Pat. No. 5,441,007 to Hunt teaches apparatus and method for docking a boat. The present invention may be used to dock motor powered or sail boats weighing upwards of several tons that when moving have a large, potentially damaging inertia due to their weight. A guide frame configuration provides a large target to which the boat can be steered, and once therein the guide frame directs the boat centrally inwardly with respect to the guide frame. The guide frame moves axially with the momentum of the boat supported by an elongate support member. One or more compression members are compressed by a stop member upon reaching the desired docking target. The compression members are compressible between push pipes that move with the guide frame on an elongate support member and a stop member that is fixed with respect to the elongate support member.

A TWELFTH EXAMPLE, U.S. Pat. No. 5,762,016 to Parsons teaches a dock pole bumper assembly for securing a boat to mooring piling. The assembly has a stationary portion which is secured to the piling and forms a track along which the movable portion glides. A movable portion has a rigid part and a flexible deformable part. The rigid part is provided with a guide channel for engaging the stationary portion during use of the bumper assembly. The resilient deformable portion has an impact-receiving contact surface and non-contacting opposing side walls. Mooring cleats are mounted on the side walls of the rigid member to allow a mooring line of a boat to be secured thereto. An insert of a friction-resistant material is fitted in the guide channel to facilitate movement of the movable portion along the stationary track.

A THIRTEENTH EXAMPLE, U.S. Pat. No. 6,422,169 to Schwantes teaches a boat mooring device for releasably securing a boat to a dock that includes a sleeve which is elongated and has a first open end and a second open end. A pair of legs are attached to the sleeve and extend away from the sleeve in the general direction of the second open end. A pair of brackets removably secure the legs to a dock. An elongated rod has a length greater than the sleeve and is extendable through the sleeve. The rod has a first end and a second end. A pair of biasing members are positioned on and bias the ends of the rod from a respectively adjacent end of the sleeves. A securing member for removably secures the first end of the rod to a boat.

It is apparent that numerous innovations for boat docking apparatuses have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a moorage for affixing to a floating dock and allowing a user to single handedly soft land, dock, and moor a boat thereto that avoids the disadvantages of the prior art.

ANOTHER OBJECT of the present invention is to provide a moorage for affixing to a floating dock and allowing a user to single handedly soft land, dock, and moor a boat thereto that is simple to use.

BRIEFLY STATED, STILL ANOTHER OBJECT of the present invention is to provide a moorage for affixing to a floating dock and allowing a user to single handedly soft land, dock, and moor a boat thereto. Attaching apparatus attaches to the floating dock. Bow stop apparatus is connected to the attaching apparatus by connecting apparatus and is engaged by a bow of the boat during mooring. The connecting apparatus is generally vertically-oriented, straight, slender, and elongated. The attaching apparatus includes a lower portion and an upper portion which both receive a lower end of the connecting member. The bow stop apparatus includes a pair of plates that diverge away from the connecting member. In an alternate embodiment, the pair of plates are resiliently attached to the connecting apparatus by coil springs that act as shock absorbers when the pair of plates are impacted upon by the bow of the boat during mooring.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the moorage of the present invention affixed to a floating dock and allowing a user to single handedly soft land, dock, and moor a boat thereto;

FIG. 3 is an enlarged exploded diagrammatic perspective view of the area generally enclosed by the dotted curve identified by ARROW 3 in FIG. 1 of a first embodiment of the bow stop apparatus of the moorage of the present invention;

LIST OF REFERENCE NUMERALS UTILIZED IN THE DRAWING

Figure 2:
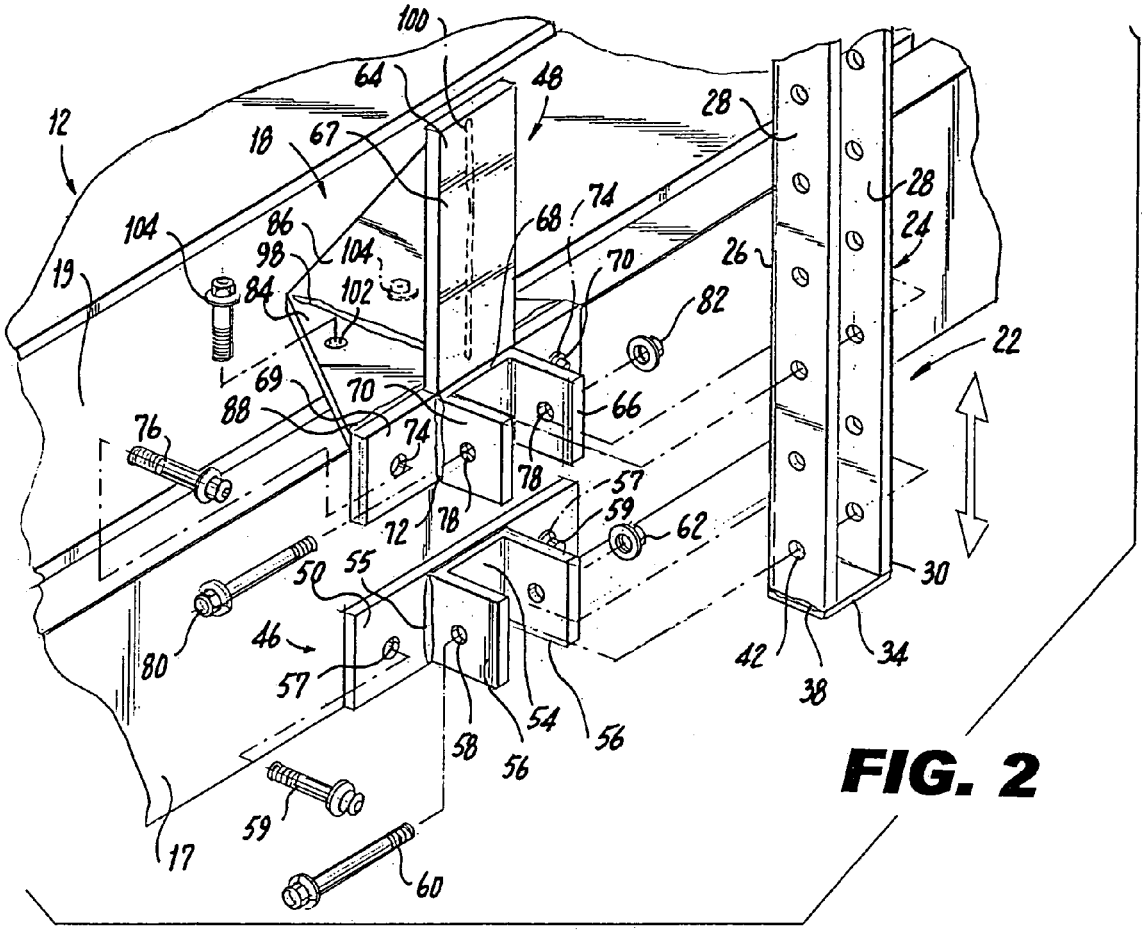
FIG. 2 is an enlarged exploded perspective view of the area generally enclosed by the dotted curve identified by ARROW 2 in FIG. 1 of the attaching apparatus of the moorage of the present invention.

- 10 moorage of present invention for affixing to floating dock 12 end allowing user to single handedly soft land, dock, and moor boat 14 thereto
- 12 floating dock
- 14 boat
- 16 bow of boat 14
- 17 front of floating dock 12
- 18 attaching apparatus for attaching to floating dock 12
- 19 top of floating dock 12
- 20 bow stop apparatus for being engaged by bow 16 of boat 14
- 22 connecting apparatus
- 24 U channel of connecting apparatus 22
- 26 web of U channel 24 of connecting apparatus 22
- 28 pair of flanges of U channel 24 of connecting apparatus 22
- 30 lower end of U channel 24 of connecting apparatus 22
- 32 upper end of U channel 24 of connecting apparatus 22
- 34 lower plate of connecting apparatus 22
- 36 upper plate of connecting apparatus 22
- 38 lower welds of connecting apparatus 22
- 40 upper welds of connecting apparatus 22
- 42 plurality of pairs of aligned through bores in U channel 24 of connecting apparatus 22
- 44 staff of connecting apparatus 22
- 46 lower portion of attaching apparatus 18 for attaching to front 17 of floating dock 12
- 48 upper portion of attaching apparatus 18 for attaching to front 17 of floating dock 12 and to top 19 of floating dock 12
- 50 plate of lower portion 46 of attaching apparatus 18 for attaching to front 17 of floating dock 12
- 52 U channel of lower portion 46 of attaching apparatus 18
- 54 web of U channel 52 of lower portion 46 of attaching apparatus 18
- 55 lower welds of lower portion 46 of attaching apparatus 18

-continued

LIST OF REFERENCE NUMERALS UTILIZED IN THE DRAWING

- 56 pair of flanges of U channel of lower portion 46 of attaching apparatus 18
- 57 pair of through bores in plate 50 of lower portion 46 of attaching apparatus 18
- 58 pair of aligned through bores in U channel 52 of lower portion 46 of attaching apparatus 18
- 59 pair of mounting screws of lower portion 46 of attaching apparatus 18 for entering front 17 of floating dock 12 and attaching lower portion 46 of attaching apparatus 18 to front 17 of floating dock 12
- 60 attaching bolt of lower portion 46 of attaching apparatus 18
- 62 nut of lower portion 46 of attaching apparatus 18
- 64 plate of upper portion 48 of attaching apparatus 18 for attaching to front 17 of floating dock 12
- 66 U channel of upper portion 48 of attaching apparatus 18
- 67 vertical portion of plate 64 of upper portion 48 of attaching apparatus 18
- 68 web of U channel 66 of upper portion 48 of attaching apparatus 18
- 69 horizontal portion of plate 64 of upper portion 48 of attaching apparatus 18
- 70 pair of flanges of U channel 66 of upper portion 48 of attaching apparatus 18
- 72 upper welds of upper portion 48 of attaching apparatus 18
- 74 pair of through bores in horizontal portion 69 of plate 64 of upper portion 48 of attaching apparatus 18
- 76 first pair of mounting screws of upper portion 48 of attaching apparatus 18 for entering front 17 of floating dock 12 and attaching upper portion 48 of attaching apparatus 18 to front 17 of floating dock 12
- 78 pair of aligned through bores in U channel 66 of upper portion 48 of attaching apparatus 18
- 80 attaching bolt of upper portion 48 of attaching apparatus 18
- 82 nut of upper portion 48 of attaching apparatus 18
- 84 horizontal brace of upper portion 48 of attaching apparatus 18 for attaching to top 19 of floating dock 12
- 86 vertical brace of horizontal brace 84 of upper portion 48 of the attaching apparatus 18
- 88 first horizontal welds of upper portion 48 of attaching apparatus 18
- 98 second horizontal welds of upper portion 48 of attaching apparatus 18
- 100 vertical welds of upper portion 48 of attaching apparatus 18
- 102 pair of through bores in horizontal brace 84 of upper portion 48 of attaching apparatus 18
- 104 second pair of mounting screws of upper portion 48 of attaching apparatus 18 for entering top 19 of floating dock 12 and attaching upper portion 48 of attaching apparatus 18 to top 19 of floating dock 12
- 106 U channel of bow stop apparatus 20
- 108 pair of plates of bow stop apparatus 20
- 110 web of U channel 106 of bow stop apparatus 20
- 112 pair of flanges of U channel 106 of bow stop apparatus 20
- 114 two pair of aligned through bores 114 in U channel 106 of bow stop apparatus 20
- 116 pair of attaching bolts of bow stop apparatus 20
- 118 pair of nuts of bow stop apparatus 20
- 120 common edge of pair of plates 108 of bow stop apparatus 20
- 121 upper end of common edge 120 of pair of plates 108 of bow stop apparatus 20
- 122 joining weld of bow atop apparatus 20
- 124 attaching welds of bow atop apparatus 20
- 126 mooring ring of bow stop apparatus 20 for receiving hooked ends 132 of mooring strap 128 which reeves cleat 130 on bow 16 of boat 14
- 128 mooring strap
- 130 cleat on bow 16 of boat 14
- 132 hooked ends of mooring strap 128

Alternate Embodiment

- 206 U channel of bow stop apparatus 220
- 208 pair of plates of bow stop apparatus 220

-continued

| Alternate Embodiment | |
|---|---|
| 210 | web of U channel 206 of bow stop apparatus 220 |
| 212 | pair of flanges of U channel 206 of bow stop apparatus 220 |
| 214 | two pair of aligned through bores in second box member 240 of bow stop apparatus 220 |
| 220 | bow stop apparatus |
| 222 | connecting apparatus |
| 224 | U channel of connecting apparatus 222 |
| 226 | web of channel 224 of connecting apparatus 222 |
| 228 | pair of flanges of U channel 224 of connecting apparatus 222 |
| 232 | upper end of first box member 236 of bow stop apparatus 220 |
| 234 | first side plate of bow stop apparatus 220 |
| 236 | first box member of bow stop apparatus 220 |
| 238 | second side plate of bow stop apparatus 220 |
| 240 | second box member of bow stop apparatus 220 |
| 242 | plurality of pairs of aligned through bores in first box member 236 of bow stop apparatus 220 |
| 243 | first pair of collars of bow stop apparatus 220 |
| 244 | pair of coil springs of bow stop apparatus 220 |
| 246 | second pair of collars of bow stop apparatus 220 |
| 248 | pair of through bores in common edge 320 of pair of plates 208 of bow stop apparatus 220 |
| 250 | pair of attaching bolts of bow stop apparatus 220 |
| 252 | nuts of bow stop apparatus 220 |
| 254 | pair of caps of bow stop apparatus 220 |
| 320 | common edge of pair of plates 208 of bow stop apparatus 220 |

DETAILED DESCRIPTION OF THE PREFERRED EMBODIMENT

Referring now to the figures, in which like numerals indicate like parts, and particularly to FIG. 1, which is a diagrammatic perspective view of the moorage of the present invention affixed to a floating dock and allowing a user to single handedly soft land, dock, and moor a boat thereto, the moorage of the present invention is shown generally at 10 for affixing to a floating dock 12 and allowing a user to single handedly soft land, dock, and moor a boat 14 thereto, wherein the boat 14 has a bow 16, and wherein the floating dock 12 has a front 17 and a top 19.

The moorage 10 comprises attaching apparatus 18, bow stop apparatus 20, and connecting apparatus 22. The attaching apparatus 18 is for attaching to the floating dock 12. The bow stop apparatus 20 is connected to the attaching apparatus 18 by the connecting apparatus 22 and is for being engaged by the bow 16 of the boat 14 during mooring.

The specific configuration of the connecting apparatus 22 can best be seen in FIGS. 2 and 3, which are, respectively, an enlarged exploded perspective view of the area generally enclosed by the dotted curve identified by ARROW 2 in FIG. 1 of the attaching apparatus of the moorage of the present invention, and, an enlarged exploded diagrammatic perspective view of the area generally enclosed by the dotted curve identified by ARROW 3 in FIG. 1 of a first embodiment of the bow stop apparatus of the moorage of the present invention, and as such, will be discussed with reference thereto.

The connecting apparatus 22 comprises a U channel 24. The U channel 24 of the connecting apparatus 22 is generally vertically-oriented, generally straight, slender, and elongated.

The U channel 24 of the connecting apparatus 22 is defined by a web 26 and a pair of flanges 28, and has a lower end 30 and an upper end 32.

The connecting apparatus 22 further comprises a lower plate 34 and an upper plate 36.

The lower plate 34 of the connecting apparatus 22 closes the lower end 30 of the U channel 24 of the connecting apparatus 22 (FIG. 2) and the upper plate 36 of the connecting apparatus 22 closes the upper end 32 of the U channel 24 of the connecting apparatus 22 (FIG. 3), both providing rigidity to the U channel 24 of the connecting apparatus 22.

The connecting apparatus 22 further comprises lower welds 38 (FIG. 2). The lower welds 38 of the connecting apparatus 22 affix the lower plate 34 of the connecting apparatus 22 to the lower end 30 of the U channel 24 of the connecting apparatus 22.

The connecting apparatus 22 further comprises upper welds 40 (FIG. 3). The upper welds 40 of the connecting apparatus 22 affix the upper plate 36 of the connecting apparatus 22 to the upper end 32 of the U channel 24 of the connecting apparatus 22.

The U channel 24 of the connecting apparatus 22 further comprises a plurality of pairs of aligned through bores 42. The plurality of pairs of aligned through bores 42 in the U channel 24 of the connecting apparatus 22 extend longitudinally along the pair of flanges 28 of the U channel 24 of the connecting apparatus 22.

Each pair of aligned through bores 42 in the U channel 24 of the connecting apparatus 22 extend through the pair of flanges 28 of the U channel 24 of the connecting apparatus 22.

The connecting apparatus 22 further comprises a staff 44. The staff 44 of the connecting apparatus 22 extends upwardly from the upper plate 36 of the connecting apparatus 22 (FIG. 3).

The specific configuration of the attaching apparatus 18 can best be seen in FIG. 2, which is an enlarged exploded perspective view of the area generally enclosed by the dotted curve identified by ARROW 2 in FIG. 1 of the attaching apparatus of the moorage of the present invention, and as such, will be discussed with reference thereto.

The attaching apparatus 18 comprises a lower portion 46 and an upper portion 48.

The lower portion 46 of the attaching apparatus 18 is physically separate from the upper portion 48 of the attaching apparatus 18.

The lower portion 46 of the attaching apparatus 18 attaches to the lower end 30 of the U channel 24 of the connecting apparatus 22 and is for attaching to the front 17 of the floating dock 12.

The upper portion 48 of the attaching apparatus 18 attaches to the lower end 30 of the U channel 24 of the connecting apparatus 22 and is for attaching to the front 17 of the floating dock 12 and to the top 19 of the floating dock 12.

The lower portion 46 of the attaching apparatus 18 comprises a plate 50 and a U channel 52.

The plate 50 of the lower portion 46 of the attaching apparatus 18 is for attaching to the front 17 of the floating dock 12.

The U channel 52 of the lower portion 46 of the attaching apparatus 18 receives the lower end 30 of the U channel 24 of the connecting apparatus, 22 and has a web 54 and a pair of flanges 56.

The web 54 of the U channel 52 of the lower portion 46 of the attaching apparatus 18 is attached to the plate 50 of the lower portion 46 of the attaching apparatus 18.

The lower portion 46 of the attaching apparatus 18 further comprises lower welds 55. The lower welds 55 of the lower portion 46 of the attaching apparatus 18 attach the web 54 of the U channel 52 of the lower portion 46 of the attaching apparatus 18 to the plate 50 of the lower portion 46 of the attaching apparatus 18.

The plate 50 of the lower portion 46 of the attaching apparatus 18 has a pair of through bores 57. The pair of through bores 57 in the plate 50 of the lower portion 46 of the attaching apparatus 18 straddle the U channel 52 of the lower portion 46 of the attaching apparatus 18.

The lower portion 46 of the attaching apparatus 18 further comprises a pair of mounting screws 59. The pair of mounting screws 59 of the lower portion 46 of the attaching apparatus 18 enter the pair of through bores 57 in the plate 50 of the lower portion 46 of the attaching apparatus 18 and are for entering the front 17 of the floating dock 12 and attaching the lower portion 46 of the attaching apparatus 18 to the front 17 of the floating dock 12.

The U channel 52 of the lower portion 46 of the attaching apparatus 18 further has a pair of aligned through bores 58. The pair of aligned through bores 58 in the U channel 52 of the lower portion 46 of the attaching apparatus 18 extend through the pair of flanges 56 of the U channel 52 of the lower portion 46 of the attaching apparatus 18.

The lower portion 46 of the attaching apparatus 18 further comprises an attaching bolt 60 and nut 62. The attaching bolt 60 of the lower portion 46 of the attaching apparatus 18 enters the through bore 58 in one flange 56 of the U channel 52 of the lower portion 46 of the attaching apparatus 18, then an appropriate pair of aligned through bores 42 in the U channel 24 of the connecting apparatus 22, then the through bore 58 in the other flange 56 of the U channel 52 of the lower portion 46 of the attaching apparatus 18, and then engages the nut 62 of the lower portion 46 of the attaching apparatus 18 to maintain the lower end 30 of the U channel 24 of the connecting apparatus 22 at a desired elevation in the lower portion 46 of the attaching apparatus 18.

The upper portion 48 of the attaching apparatus 18 comprises a plate 64 and a U channel 66.

The plate 64 of the upper portion 48 of the attaching apparatus 18 is inverted T-shaped, has a vertical portion 67 and a horizontal portion 69, and is for attaching to the front 17 of the floating dock 12.

The U channel 66 of the upper portion 48 of the attaching apparatus 18 receives the lower end 30 of the U channel 24 of the connecting apparatus 22, and has a web 68 and a pair of flanges 70.

The web 68 of the U channel 66 of the upper portion 48 of the attaching apparatus 18 is attached to the horizontal portion 69 of the plate 64 of the upper portion 48 of the attaching apparatus 18.

The upper portion 48 of the attaching apparatus 18 further comprises upper welds 72. The upper welds 72 of the upper portion 48 of the attaching apparatus 18 attach the web 68 of the U channel 66 of the upper portion 48 of the attaching apparatus 18 to the horizontal portion 69 of the plate 64 of the upper portion 48 of the attaching apparatus 18.

The horizontal portion 69 of the plate 64 of the upper portion 48 of the attaching apparatus 18 has a pair of through bores 74. The pair of through bores 74 in the horizontal portion 69 of the plate 64 of the upper portion 48 of the attaching apparatus 18 straddle the U channel 66 of the upper portion 48 of the attaching apparatus 18.

The upper portion 48 of the attaching apparatus 18 further comprises a first pair of mounting screws 76. The first pair of mounting screws 76 of the upper portion 48 of the attaching apparatus 18 enter the pair of through bores 74 in the horizontal portion 69 of the plate 64 of the upper portion 48 of the attaching apparatus 18 and are for entering the front 17 of the floating dock 12 and attaching the upper portion 48 of the attaching apparatus 18 to the front 17 of the floating dock 12.

The U channel 66 of the upper portion 48 of the attaching apparatus 18 further has a pair of aligned through bores 78. The pair of aligned through bores 78 in the U channel 66 of the upper portion 48 of the attaching apparatus 18 extend through the pair of flanges 70 of the U channel 66 of the upper portion 48 of the attaching apparatus 18.

The upper portion 48 of the attaching apparatus 18 further comprises an attaching bolt 80 and nut 82. The attaching bolt 80 of the upper portion 48 of the attaching apparatus 18 enters the through bore 78 in one flange 70 of the U channel 66 of the upper portion 48 of the attaching apparatus 18, then an appropriate pair of aligned through bores 42 in the U channel 24 of the connecting apparatus 22, then the through bore 78 in the other flange 70 of the U channel 66 of upper lower portion 48 of the attaching apparatus 18, and then engages the nut 82 of the upper portion 48 of the attaching apparatus 18 to maintain the lower end 30 of the U channel 24 of the connecting apparatus 22 at the desired elevation in the upper portion 48 of the attaching apparatus 18 and prevent cocking of the connecting apparatus 22 relative to the attaching apparatus 18.

The upper portion 48 of the attaching apparatus 18 further comprises a horizontal brace 84 and a vertical brace 86.

The horizontal brace 84 of the upper portion 48 of the attaching apparatus 18 is triangular-shaped for stress relief, extends rearwardly from the horizontal portion 69 of the plate 64 of the upper portion 48 of the attaching apparatus 18, and is for attaching to the top 19 of the floating dock 12.

The upper portion 48 of the attaching apparatus 18 further comprises first horizontal welds 88. The first horizontal welds 88 of the upper portion 48 of the attaching apparatus 18 attach the horizontal brace 84 of the upper portion 48 of the attaching apparatus 18 to the horizontal portion 69 of the plate 64 of the upper portion 48 of the attaching apparatus 18.

The vertical brace 86 of the upper portion 48 of the attaching apparatus 18 is triangular-shaped for stress relief and extends rearwardly from the vertical portion 67 of the plate 64 of the upper portion 48 of the attaching apparatus 18 and upwardly from the horizontal brace 84 of the upper portion 48 of the attaching apparatus 18.

The upper portion 48 of the attaching apparatus 18 further comprises second horizontal welds 98. The second horizontal welds 98 of the upper portion 48 of the attaching apparatus 18 attach the vertical brace 86 of the upper portion 48 of the attaching apparatus 18 to the horizontal brace 84 of the upper portion 48 of the attaching apparatus 18.

The upper portion 48 of the attaching apparatus 18 further comprises vertical welds 100. The vertical welds 100 of the upper portion 48 of the attaching apparatus 18 attach the vertical brace 86 of the upper portion 48 of the attaching apparatus 18 to the vertical portion 67 of the plate 64 of the upper portion 48 of the attaching apparatus 18.

The horizontal brace 84 of the upper portion 48 of the attaching apparatus 18 has a pair of through bores 102. The pair of through bores 102 in the horizontal brace 84 of the upper portion 48 of the attaching apparatus 18 straddle the vertical brace 86 of the upper portion 48 of the attaching apparatus 18.

The upper portion 48 of the attaching apparatus 18 further comprises a second pair of mounting screws 104. The second pair of mounting screws 104 of the upper portion 48 of the attaching apparatus 18 enter the pair of through bores 102 in the horizontal brace 84 of the upper portion 48 of the attaching apparatus 18 and are for entering the top 19 of the floating dock 12 and attaching the upper portion 48 of the attaching apparatus 18 to the top 19 of the floating dock 12.

Figure 4:
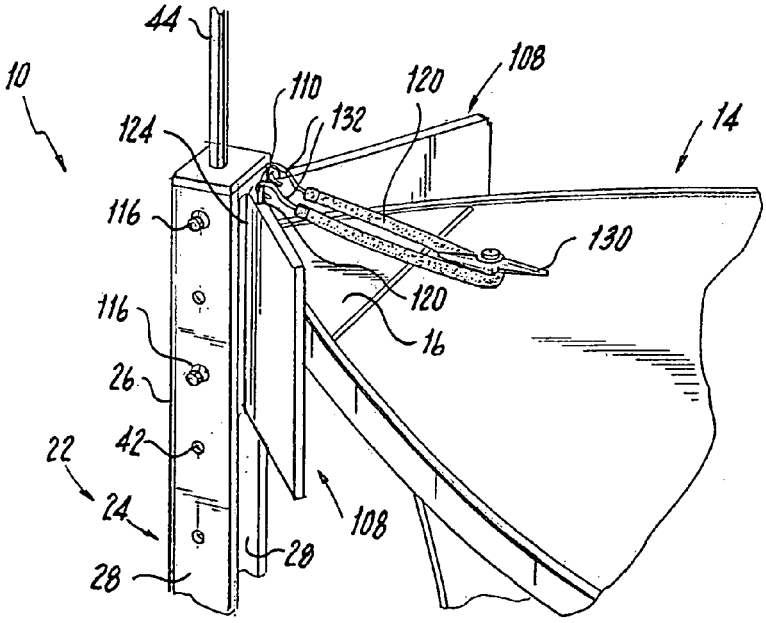
FIG. 4 is a diagrammatic perspective view of the area generally enclosed by the dotted curve identified by ARROW 4 in FIG. 1 of a boat affixed to the bow stop of the moorage of the present invention.

The specific configuration of the bow stop apparatus 20 can best be seen in FIGS. 3 and 4, which are, respectively, an enlarged exploded diagrammatic perspective view of the area generally enclosed by the dotted curve identified by ARROW 3 in FIG. 1 of a first embodiment of the bow stop apparatus of the moorage of the present invention, and, a diagrammatic perspective view of the area generally enclosed by the dotted curve identified by ARROW 4 in FIG. 1 of a boat affixed to the bow stop of the moorage of the present invention, and as such, will be discussed with reference thereto.

The bow stop apparatus 20 comprises a U channel 106 and a pair of plates 108.

The U channel 106 of the bow stop apparatus 20 is received by the upper end 32 of the U channel 24 of the connecting apparatus 22, and has a web 110 and a pair of flanges 112.

The U channel 106 of the bow stop apparatus 20 further has two pair of aligned through bores 114. The two pair of aligned through bores 114 in the U channel 106 of the bow stop apparatus 20 extend through the pair of flanges 112 of the U channel 106 of the bow stop apparatus 20.

The bow stop apparatus 20 further comprises a pair of attaching bolts 116 and nuts 118. The pair of attaching bolts 116 of the bow stop apparatus 20 enter an appropriate pair of through bores 42 in one flange 28 of the U channel 24 of the connecting apparatus 22, respectively, then the pair of through bores 114 in one flange 112 of the U channel 106 of the bow stop apparatus 20, respectively, then the pair of through bores 114 in the other flange 112 of the U channel 106 of the bow stop apparatus 20, respectively, an appropriate pair of through bores 42 in the other flange 28 of the U channel 24 of the connecting apparatus 22, respectively, and then engages the pair of nuts 118 of the bow stop apparatus 20, respectively, to maintain the U channel 106 of the bow stop apparatus 20 at a desired elevation in the upper end 32 of the U channel 24 of the connecting apparatus 22.

The pair of plates 108 of the bow stop apparatus 20 are attached to each other at a common edge 120 thereof having an upper end 121, and diverge therefrom away from the U channel 106 of the bow stop apparatus 20.

The bow stop apparatus 20 further comprises a joining weld 122. The Joining weld 122 of the bow stop apparatus 20 attaches the pair of plates 108 of the bow stop apparatus 20 to each other at the common edge 120 thereof.

The common edge 120 of the pair of plates 108 of the bow stop apparatus 20 is attached to the web 110 of the U channel 106 of the bow stop apparatus 20.

The bow stop apparatus 20 further comprises attaching welds 124. The attaching welds 124 of the bow stop apparatus 20 attach the common edge 120 of the pair of plates 108 of the bow stop apparatus 20 to the web 110 of the U channel 106 of the bow stop apparatus 20.

The bow stop apparatus 20 further comprises a mooring ring 126. The mooring ring 126 of the bow stop apparatus 20 extends upwardly from the upper end 121 of the common edge 120 of the pair of plates 108 of the bow stop apparatus 20 and is for receiving hooked ends 132 of a mooring strap 128 which reeves a cleat 130 on the bow 16 of the boat 14.

Figure 5:
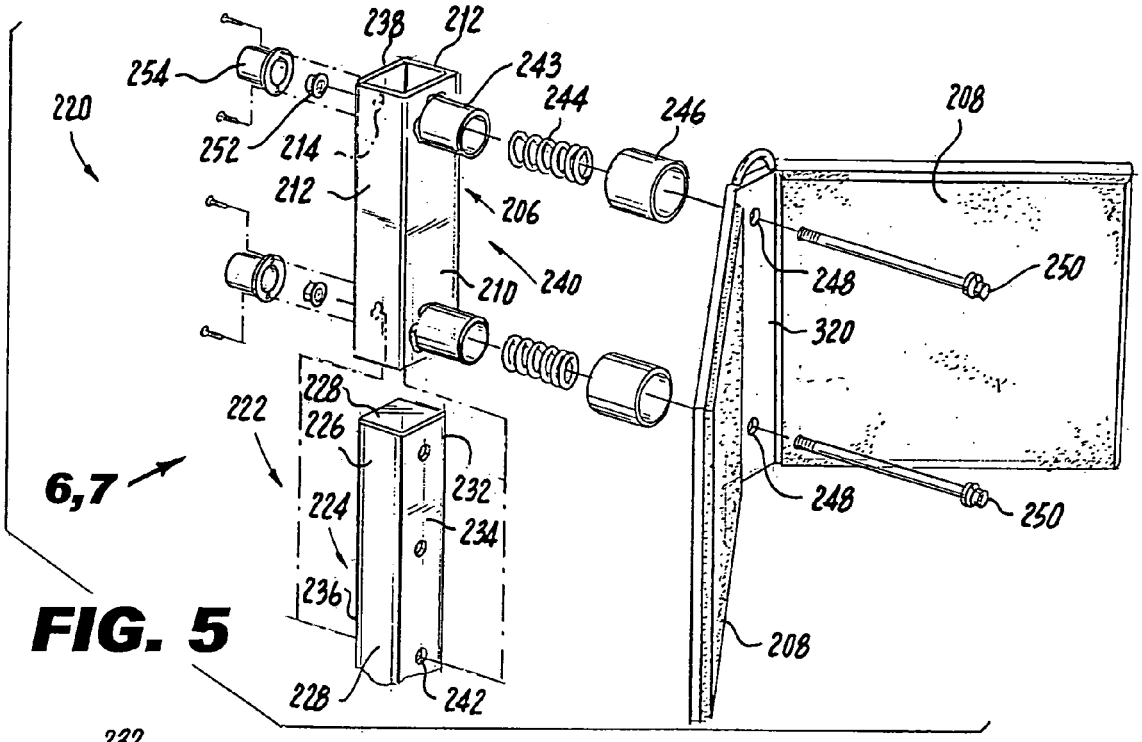
FIG. 5 is an enlarged exploded diagrammatic perspective view of the area generally enclosed by the dotted curve identified by ARROW 5 in FIG. 1 of a second embodiment of the bow stop apparatus of the moorage of the present invention.
Figure 6:
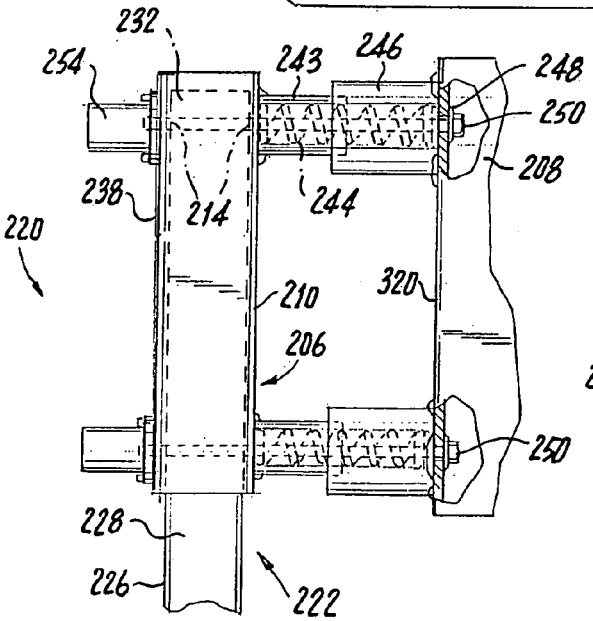
FIG. 6 is an enlarged diagrammatic side elevational view taken generally in the direction of ARROW 6 in FIG. 5 of the second embodiment of the bow stop apparatus of the moorage of the present invention prior to engagement with a boat.
Figure 7:
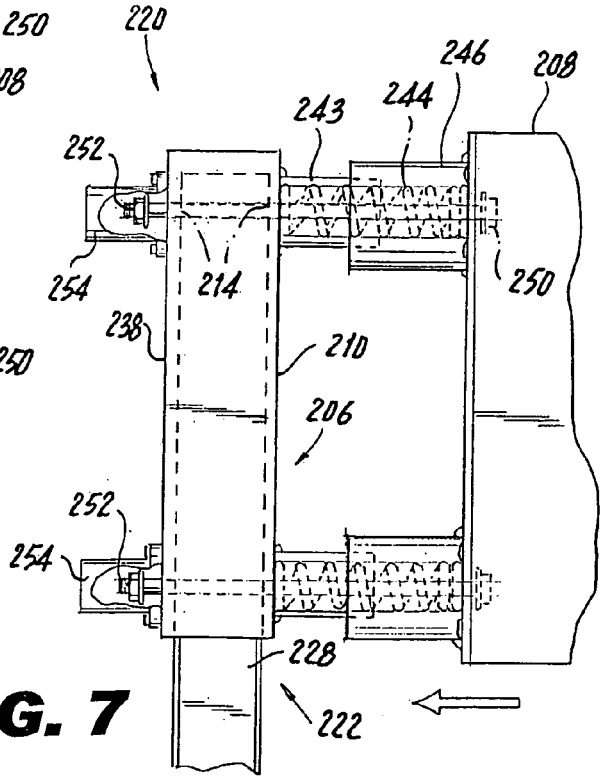
FIG. 7 is an enlarged diagrammatic side elevational view taken generally in the direction of ARROW 7 in FIG. 5 of the second embodiment of the bow stop apparatus of the moorage of the present invention compressing as a result of engagement with the boat.

An alternate embodiment of a bow stop apparatus 220 can best be seen in FIGS. 5–7, which are, respectively, an enlarged exploded diagrammatic perspective view of the area generally enclosed by the dotted curve identified by ARROW 5 in FIG. 1 of a second embodiment of the bow stop apparatus of the moorage of the present invention, an enlarged diagrammatic side elevational view taken generally in the direction of ARROW 6 in FIG. 5 of the second embodiment of the bow stop apparatus of the moorage of the present invention prior to engagement with a boat, and, an enlarged diagrammatic side elevational view taken generally in the direction of ARROW 7 in FIG. 5 of the second embodiment of the bow stop apparatus of the moorage of the present invention compressing as a result of engagement with the boat, and as such, will be discussed with reference thereto.

The bow stop apparatus 220 comprises a first side plate 234. The first side plate 234 of the bow stop apparatus 220 converts a U channel 224 of a connecting apparatus 222 into a first box member 236 by extending from one flange 228 of U channel 224 of the connecting apparatus 222 to other flange 228 of the U channel 224 of the connecting apparatus 222.

The bow stop apparatus 220 comprises a second side plate 238. The second side plate 238 of the bow stop apparatus 220 converts a U channel 206 of the bow stop apparatus 220 into a second box member 240 by extending from one flange 212 of the U channel 206 of the bow stop apparatus 220 to an other flange 212 of the U channel 206 of the bow stop apparatus 220.

The second box member 240 of the bow stop apparatus 220 receives an upper end 232 of the first box member 236 of the bow stop apparatus 220.

The first box member 236 of the bow stop apparatus 220 comprises a plurality of pairs of aligned through bores 242. The plurality of pairs of aligned through bores 242 in the first box member 236 of the bow stop apparatus 220 extend longitudinally along ae web 226 of the U channel 224 of the connecting apparatus 222 and the first side plate 234 of the bow stop apparatus 220.

The second box member 240 of the bow stop apparatus 20 has two pair of aligned through bores 214. The two pair of aligned through bores 214 in the second box member 240 of the bow stop apparatus 220 extend through a web 210 of the U channel 206 of the bow stop apparatus 220 and the second side plate 238 of the bow stop apparatus 220.

The bow stop apparatus 220 further comprises a first pair of collars 243. The first pair of collars 243 of the bow stop apparatus 220 are attached to, and extend from, the web 210 of the U channel 206 of the bow stop apparatus 220, and are coaxial with the two pair of aligned through bores 214 in the second box member 240 of the bow stop apparatus 220, respectively.

The bow stop apparatus 220 further comprises a pair of coil springs 244. The pair of coil springs 244 of the bow stop apparatus 220 sit in, and extend out of, the first pair of collars 243 of the bow stop apparatus 220, respectively.

The bow stop apparatus 220 further comprises a second pair of collars 246. The second pair of collars 246 of the bow stop apparatus 220 are attached to, and extend from, a common edge 320 of a pair of plates 208 of the bow stop apparatus 220, and are coaxial with, and receive, the first pair of collars 243 of the bow stop apparatus 220.

The common edge 320 of the pair of plates 208 of the bow stop apparatus 220 has a pair of through bores 248 therethrough. The pair of through bores 248 in the common edge 320 of the pair of plates 208 of the bow stop apparatus 220 are coaxial with the second pair of collars 246 of the bow stop apparatus 220.

The bow stop apparatus 220 further comprises a pair attaching bolts 250 and nuts 252. The pair of attaching bolts 250 of the bow stop apparatus 220 enter the pair of through bores 248 in the common edge 320 of the pair of plates 208 of the bow stop apparatus 220, respectively, then the second pair of collars 246 of the bow stop apparatus 220, respectively, then the pair of coil springs 244 of the bow stop apparatus 220, respectively, then the first pair of collars 243 of the bow stop apparatus 220, respectively, then the first pair of aligned through bores 214 in the web 210 of the U channel 206 of the bow stop apparatus 220 respectively, then the first pair of aligned through bores 242 in the first side plate 234 of the first box member 236 of the connecting apparatus 222 respectively, then the second pair of aligned through bores 242 in the web 226 of the first box member 236 of the connecting apparatus 222 respectively, an the second pair of aligned through bores 214 in the second side plate 238 of the bow stop apparatus 220, respectively, and then engage the nuts 252 of the bow stop apparatus 220, respectively, to maintain the second box member 240 of the bow stop apparatus 220 at a desired elevation on the upper end 232 of the first box member 236 of the connecting apparatus 222 and to allow the pair of plates 208 of the bow stop apparatus 220 to move relative to the second box member 240 of the bow stop apparatus 220 when impacted upon by the bow 16 of the boat 14 during mooring, with the pair of coil springs 244 of the bow stop apparatus 220 forming shock absorbers.

The bow stop apparatus 220 further comprises a pair of caps 254. The pair of caps 254 of the bow stop apparatus 220 are replaceably attached to, and extend from, the second side plate 238 of the bow stop apparatus 220, and are coaxial with, and cover to protect, the nuts 252 of the bow stop apparatus 220.

It will be understood that each of the elements described above, or two or more together, may also find a useful application in other types of constructions differing from the types described above.

While the invention has been illustrated and described as embodied in a moorage for affixing to a floating dock and allowing a user to single handedly soft land, dock, and moor a boat thereto, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A moorage for affixing to a floating dock and allowing a user to single handedly soft land, dock, and moor a boat thereto, wherein the boat has a bow, and wherein the floating dock has a front and a top, said moorage comprising:

a) attaching apparatus;

b) bow stop apparatus; and c) connecting apparatus;

wherein said attaching apparatus is for attaching to the floating dock;

wherein said bow stop apparatus is connected to said attaching apparatus by said connecting apparatus; and wherein said bow stop apparatus is for being engaged by the bow of the boat during mooring, wherein said connecting apparatus comprises a U channel, wherein said U channel of said connecting apparatus is generally vertically-oriented;

wherein said U channel of said connecting apparatus is generally straight;

wherein said U channel of said connecting apparatus is slender; and wherein said U channel of said connecting apparatus is elongated.

2. The moorage as defined in claim 1, wherein said U channel of said connecting apparatus is defined by a web; and wherein said U channel of said connecting apparatus is defined by a pair of flanges.

3. The moorage as defined in claim 2, wherein said U channel of said connecting apparatus has a lower end; and wherein said U channel of said connecting apparatus has an upper end.

4. The moorage as defined in claim 3, wherein said connecting apparatus comprises a lower plate; and wherein said connecting apparatus comprises an upper plate.

5. The moorage as defined in claim 4, wherein said lower plate of said connecting apparatus closes said lower end of said U channel of said connecting apparatus and said upper plate of said connecting apparatus closes said upper end of said U channel of said connecting apparatus providing rigidity to said U channel of said connecting apparatus.

6. The moorage as defined in claim 5, wherein said connecting apparatus comprises lower welds.

7. The moorage as defined in claim 6, wherein said lower welds of said connecting apparatus affix said lower plate of said connecting apparatus to said lower end of said U channel of said connecting apparatus.

8. The moorage as defined in claim 5, wherein said connecting apparatus comprises upper welds.

9. The moorage as defined in claim 8, wherein said upper welds of said connecting apparatus affix said upper plate of said connecting apparatus to said upper end of said U channel of said connecting apparatus.

10. The moorage as defined in claim 2, wherein said U channel of said connecting apparatus comprises a plurality of pairs of aligned through bores.

11. The moorage as defined in claim 10, wherein said plurality of pairs of aligned through bores in said U channel of said connecting apparatus extend longitudinally along said pair of flanges of said U channel of said connecting apparatus.

12. The moorage as defined in claim 10, wherein each said pair of aligned through bores in said U channel of said connecting apparatus extend through said pair of flanges of said U channel of said connecting apparatus.

13. The moorage as defined in claim 4, wherein said connecting apparatus comprises a staff.

14. The moorage as defined in claim 13, wherein said staff of said connecting apparatus extends upwardly from said upper plate of said connecting apparatus.

15. The moorage as defined in claim 3, wherein said attaching apparatus comprises a lower portion; and wherein said attaching apparatus comprises an upper portion.

16. The moorage as defined in claim 15, wherein said lower portion of said attaching apparatus is physically separate from said upper portion of said attaching apparatus.

17. The moorage as defined in claim 15, wherein said lower portion of said attaching apparatus attaches to said lower end of said U channel of said connecting apparatus; and wherein said lower portion of said attaching apparatus is for attaching to the front of the floating dock.

18. The moorage as defined in claim 15, wherein said upper portion of said attaching apparatus attaches to said lower end of said U channel of said connecting apparatus;

wherein said upper portion of said attaching apparatus is for attaching to the front of the floating dock; and wherein said upper portion of said attaching apparatus is for attaching to the top of the floating dock.

19. The moorage as defined in claim 15, wherein said lower portion of said attaching apparatus comprises a plate;

wherein said lower portion of said attaching apparatus comprises a U channel; and wherein said plate of said lower portion of said attaching apparatus is for attaching to the front of the floating dock.

20. The moorage as defined in claim 19, wherein said U channel of said lower portion of said attaching apparatus receives said lower end of said U channel of said connecting apparatus.

21. The moorage as defined in claim 19, wherein said U channel of said lower portion of said attaching apparatus has a web; and wherein said U channel of said lower portion of said attaching apparatus has a pair of flanges.

22. The moorage as defined in claim 21, wherein said web of said U channel of said lower portion of said attaching apparatus is attached to said plate of said lower portion of said attaching apparatus.

23. The moorage as defined in claim 21, wherein said lower portion of said attaching apparatus comprises lower welds.

24. The moorage as defined in claim 23, wherein said lower welds of said lower portion of said attaching apparatus attach said web of said U channel of said lower portion of said attaching apparatus to said plate of said lower portion of said attaching apparatus.

25. The moorage as defined in claim 19, wherein said plate of said lower portion of said attaching apparatus has a pair of through bores.

26. The moorage as defined in claim 25, wherein said pair of through bores in said plate of said lower portion of said attaching apparatus straddle said U channel of said lower portion of said attaching apparatus.

27. The moorage as defined in claim 25, wherein said lower portion of said attaching apparatus comprises a pair of mounting screws.

28. The moorage as defined in claim 27, wherein said pair of mounting screws of said lower portion of said attaching apparatus enter said pair of through bores in said plate of said lower portion of said attaching apparatus and are then for entering the front of the floating dock and attaching said lower portion of said attaching apparatus to the front of the floating dock.

29. The moorage as defined in claim 21, wherein said U channel of said lower portion of said attaching apparatus has a pair of aligned through bores.

30. The moorage as defined in claim 29, wherein said pair of aligned through bores in said U channel of said lower portion of said attaching apparatus extend through said pair of flanges of said U channel of said lower portion of said attaching apparatus.

31. The moorage as defined in claim 30, wherein said lower portion of said attaching apparatus comprises an attaching bolt; and wherein said lower portion of said attaching apparatus comprises a nut.

32. The moorage as defined in claim 31, wherein said attaching bolt of said lower portion of said attaching apparatus enters one through bore in one said flange of said U channel of said lower portion of said attaching apparatus, then said appropriate pair of aligned through bores in said U channel of said connecting apparatus, then said other through bore in said other flange of said U channel of said lower portion of said attaching apparatus, and then engages said nut of said lower portion of said attaching apparatus to maintain said lower end of said U channel of said connecting apparatus at a desired elevation in said lower portion of said attaching apparatus.

33. The moorage as defined in claim 15, wherein said upper portion of said attaching apparatus comprises a plate; and wherein said upper portion of said attaching apparatus comprises a U channel.

34. The moorage as defined in claim 33, wherein said plate of said upper portion of said attaching apparatus is inverted T-shaped.

35. The moorage as defined in claim 33, wherein said plate of said upper portion of said attaching apparatus has a vertical portion;

wherein said plate of said upper portion of said attaching apparatus has a horizontal portion; and wherein said horizontal portion of said plate of said upper portion of said attaching apparatus is for attaching to the front of the floating dock.

36. The moorage as defined in claim 33, wherein said U channel of said upper portion of said attaching apparatus receives said lower end of said U channel of said connecting apparatus.

37. The moorage as defined in claim 35, wherein said U channel of said upper portion of said attaching apparatus has a web; and wherein said U channel of said upper portion of said attaching apparatus has a pair of flanges.

38. The moorage as defined in claim 37, wherein said web of said U channel of said upper portion of said attaching apparatus is attached to said horizontal portion of said plate of said upper portion of said attaching apparatus.

39. The moorage as defined in claim 38, wherein said upper portion of said attaching apparatus comprises upper welds.

40. The moorage as defined in claim 39, wherein said upper welds of said upper portion of said attaching apparatus attach said web of said U channel of said upper portion of said attaching apparatus to said horizontal portion of said plate of said upper portion of said attaching apparatus.

41. The moorage as defined in claim 33, wherein said horizontal portion of said plate of said upper portion of said attaching apparatus has a pair of through bores.

42. The moorage as defined in claim 41, wherein said pair of through bores in said horizontal portion of said plate of said upper portion of said attaching apparatus straddle said U channel of said upper portion of said attaching apparatus.

43. The moorage as defined in claim 41, wherein said upper portion of said attaching apparatus comprises a first pair of mounting screws.

44. The moorage as defined in claim 43, wherein said first pair of mounting screws of said upper portion of said attaching apparatus enter said pair of through bores in said horizontal portion of said plate of said upper portion of said attaching apparatus; and wherein said first pair of mounting screws of said upper portion of said attaching apparatus are for entering the front of the floating dock and attaching said upper portion of said attaching apparatus to the front of said floating dock.

45. The moorage as defined in claim 37, wherein said U channel of said upper portion of said attaching apparatus has a pair of aligned through bores.

46. The moorage as defined in claim 45, wherein said pair of aligned through bores in said U channel of said upper portion of said attaching apparatus extend through said pair of flanges of said U channel of said upper portion of said attaching apparatus.

47. The moorage as defined in claim 46, wherein said upper portion of said attaching apparatus comprises an attaching bolt; and wherein said upper portion of said attaching apparatus comprises a nut.

48. The moorage as defined in claim 47, wherein said attaching bolt of said upper portion of said attaching apparatus enters one said through bore in one said flange of said U channel of said upper portion of said attaching apparatus, then said appropriate pair of aligned through bores in said U channel of said connecting apparatus, and then said other through bore in said other flange of said U channel of said upper lower portion of said attaching apparatus, and then engages said nut of said upper portion of said attaching apparatus to maintain said lower end of said U channel of said connecting apparatus at a desired elevation in said upper portion of said attaching apparatus and prevent cocking of said connecting apparatus relative to said attaching apparatus.

49. The moorage as defined in claim 3, wherein an upper portion of said attaching apparatus comprises a horizontal brace; and wherein said upper portion of said attaching apparatus comprises a vertical brace.

50. The moorage as defined in claim 49, wherein said horizontal brace of said upper portion of said attaching apparatus is triangular-shaped for stress relief.

51. The moorage as defined in claim 49, wherein said horizontal brace of said upper portion of said attaching apparatus extends rearwardly from said horizontal portion of said plate of said upper portion of said attaching apparatus; and wherein said horizontal brace of said upper portion of said attaching apparatus is for attaching to the top of the floating dock.

52. The moorage as defined in claim 49, wherein said upper portion of said attaching apparatus comprises first horizontal welds.

53. The moorage as defined in claim 52, wherein said first horizontal welds of said upper portion of said attaching apparatus attach said horizontal brace of said upper portion of said attaching apparatus to said horizontal portion of said plate of said upper portion of said attaching apparatus.

54. The moorage as defined in claim 49, wherein said vertical brace of said upper portion of said attaching apparatus is triangular-shaped for stress relief.

55. The moorage as defined in claim 49, wherein said vertical brace of said upper portion of said attaching apparatus extends rearwardly from said vertical portion of said plate of said upper portion of said attaching apparatus; and wherein said vertical brace of said upper portion of said attaching apparatus extends upwardly from said horizontal brace of said upper portion of said attaching apparatus.

56. The moorage as defined in claim 49, wherein said upper portion of said attaching apparatus comprises second horizontal welds.

57. The moorage as defined in claim 56, wherein said second horizontal welds of said upper portion of said attaching apparatus attach said vertical brace of said upper portion of said attaching apparatus to said horizontal brace of said upper portion of said attaching apparatus.

58. The moorage as defined in claim 49, wherein said upper portion of said attaching apparatus comprises vertical welds.

59. The moorage as defined in claim 58, wherein said vertical welds of said upper portion of said attaching apparatus attach said vertical brace of said upper portion of said attaching apparatus to said vertical portion of said plate of said upper portion of said attaching apparatus.

60. The moorage as defined in claim 49, wherein said horizontal brace of said upper portion of said attaching apparatus has a pair of through bores.

61. The moorage as defined in claim 60, wherein said pair of through bores in said horizontal brace of said upper portion of said attaching apparatus straddle said vertical brace of said upper portion of said attaching apparatus.

62. The moorage as defined in claim 60, wherein said upper portion of said attaching apparatus comprises a second pair of mounting screws.

63. The moorage as defined in claim 62, wherein said second pair of mounting screws of said upper portion of said attaching apparatus enter said pair of through bores in said horizontal brace of said upper portion of said attaching apparatus and are for then entering the top of the floating dock and attaching said upper portion of said attaching apparatus to the top of the floating dock.

64. The moorage as defined in claim 3, wherein said bow stop apparatus comprises a U channel; and wherein said bow stop apparatus comprises a pair of plates.

65. The moorage as defined in claim 64, wherein said U channel of said bow stop apparatus is received by said upper end of said U channel of said connecting apparatus.

66. The moorage as defined in claim 64, wherein said U channel of said bow stop apparatus has a web; and wherein said U channel of said bow stop apparatus has a pair of flanges.

67. The moorage as defined in claim 66, wherein said U channel of said bow stop apparatus has two pair of aligned through bores.

68. The moorage as defined in claim 67, wherein said two pair of aligned through bores in said U channel of said bow stop apparatus extend through said pair of flanges of said U channel of said bow stop apparatus.

69. The moorage as defined in claim 67, wherein said bow stop apparatus comprises a pair of attaching bolts; and wherein said bow stop apparatus comprises a pair of nuts.

70. The moorage as defined in claim 69, wherein said pair of attaching bolts of said bow stop apparatus enter said appropriate pair of through bores in one said flange of said U channel of said connecting apparatus, then said pair of through bores in one said flange of said U channel of said bow stop apparatus, then said other pair of through bores in said other flange of said U channel of said bow stop apparatus, then said appropriate pair of through bores in other said flange of said U channel of said connecting apparatus, and then engages said pair of nuts of said bow stop apparatus to maintain said U channel of said bow stop apparatus at a desired elevation in said upper end of said U channel of said connecting apparatus.

71. The moorage as defined in claim 66, wherein said pair of plates of said bow stop apparatus are attached to each other at a common edge thereof with an upper end and diverge therefrom away from said U channel of said bow stop apparatus.

72. The moorage as defined in claim 71, wherein said bow stop apparatus has a joining weld.

73. The moorage as defined in claim 72, wherein said joining weld of said bow stop apparatus attaches said pair of plates of said bow stop apparatus to each other at said common edge thereof.

74. The moorage as defined in claim 71, wherein said common edge of said pair of plates of said bow stop apparatus is attached to said web of said U channel of said bow stop apparatus.

75. The moorage as defined in claim 71, wherein said bow stop apparatus comprises attaching welds.

76. The moorage as defined in claim 75, wherein said attaching welds of said bow stop apparatus attaches said common edge of said pair of plates of said bow stop apparatus to said web of said U channel of said bow stop apparatus.

77. The moorage as defined in claim 71, wherein said bow stop apparatus comprises a mooring ring.

78. The moorage as defined in claim 77, wherein said mooring ring of said bow stop apparatus extends upwardly from said upper end of said common edge of said pair of plates of said bow stop apparatus; and said mooring ring of said bow stop apparatus is for receiving hooked ends of a mooring strap which reeves a cleat on the bow of the boat.

79. The moorage as defined in claim 71, wherein said bow stop apparatus comprises a first side plate.

80. The moorage as defined in claim 79, wherein said first side plate of said bow stop apparatus converts said U channel of said connecting apparatus into a first box member by extending from said one flange of said U channel of said connecting apparatus to other said flange of said U channel of said connecting apparatus.

81. The moorage as defined in claim 80, wherein said bow stop apparatus comprises a second side plate.

82. The moorage as defined in claim 81, wherein said second side plate of said bow stop apparatus converts said U channel of said bow stop apparatus into a second box member by extending from one said flange of said U channel of said bow stop apparatus to the other said flange of said U channel of said bow stop apparatus.

83. The moorage as defined in claim 82, wherein said second box member of said bow stop apparatus receives an upper end of said first box member of said bow stop apparatus.

84. The moorage as defined in claim 80, wherein said first box member of said bow stop apparatus comprises a plurality of pairs of aligned through bores.

85. The moorage as defined in claim 84, wherein said plurality of pairs of aligned through bores in said first box member of said bow stop apparatus extend longitudinally along said web of said U channel of said connecting apparatus and said first side plate of said bow stop apparatus.

86. The moorage as defined in claim 82, wherein said second box member of said bow stop apparatus has two pair of aligned through bores.

87. The moorage as defined in claim 86, wherein said two pair of aligned through bores in said second box member of said bow stop apparatus extend through said web of said U channel of said bow stop apparatus and said second side plate of said bow stop apparatus.

88. The moorage as defined in claim 87, wherein said bow stop apparatus comprises a first pair of collars.

89. The moorage as defined in claim 88, wherein said first pair of collars of said bow stop apparatus are attached to said web of said U channel of said bow stop apparatus;

wherein said first pair of collars of said bow stop apparatus extend from said web of said U channel of said bow stop apparatus; and wherein said first pair of collars of said bow stop apparatus are coaxial with said two pair of aligned through bores in said second box member of said bow stop apparatus, respectively.

90. The moorage as defined in claim 88, wherein said bow stop apparatus comprises a pair of coil springs.

91. The moorage as defined in claim 90, wherein said pair of coil springs of said bow stop apparatus sit in said first pair of collars of said bow stop apparatus, respectively; and wherein said pair of coil springs of said bow stop apparatus extend out of said first pair of collars of said bow stop apparatus, respectively.

92. The moorage as defined in claim 91, wherein said bow stop apparatus comprises a second pair of collars.

93. The moorage as defined in claim 92, wherein said second pair of collars of said bow stop apparatus are attached to said common edge of said pair of plates of said bow stop apparatus;

wherein said second pair of collars of said bow stop apparatus extend from said common edge of said pair of plates of said bow stop apparatus; and wherein said second pair of collars of said bow stop apparatus are coaxial with said first pair of collars of said bow stop apparatus.

94. The moorage as defined in claim 92, wherein said common edge of said pair of plates of said bow stop apparatus has a pair of through bores therethrough.

95. The moorage as defined in claim 94, wherein said pair of through bores in said common edge of said pair of plates of said bow stop apparatus are coaxial with said second pair of collars of said bow stop apparatus, respectively.

96. The moorage as defined in claim 94, wherein said bow stop apparatus comprises a pair attaching bolts and nuts.

97. The moorage as defined in claim 96, wherein said pair of attaching bolts of said bow stop apparatus enter said pair of through bores in said common edge of said pair of plates of said bow stop apparatus, respectively, then said second pair of collars of said bow stop apparatus, respectively, then said pair of coil springs of said bow stop apparatus, respectively, then said first pair of collars of said bow stop apparatus, respectively, then said first pair of aligned through bores in said web of said U channel of said bow stop apparatus respectively, then said first pair of aligned through bores in said first side plate of said first box member of said connecting apparatus respectively, then said second pair of aligned through bores in said web of said first box member of said connecting apparatus respectively, an said second pair of aligned through bores in said second side plate of said bow stop apparatus, respectively, and then engage said nuts of said bow stop apparatus, respectively, to maintain said second box member of said bow stop apparatus at a desired elevation on said upper end of said first box member of said connecting apparatus and to allow said pair of plates of said bow stop apparatus to move relative to said second box member of said bow stop apparatus when impacted upon by the bow of the boat during mooring, with said pair of coil springs of said bow stop apparatus forming shock absorbers.

98. The moorage as defined in claim 96, wherein said bow stop apparatus comprises a pair of caps.

99. The moorage as defined in claim 98, wherein said pair of caps of said bow stop apparatus are replaceably attached to said second side plate of said bow stop apparatus;

wherein said pair of caps of said bow stop apparatus extend from said second side plate of said bow stop apparatus;

wherein said pair of caps of said bow stop apparatus are coaxial with said nuts of said bow stop apparatus; and wherein said pair of caps of said bow stop apparatus cover to protect said nuts of said bow stop apparatus.

* * * * *